US009957650B1

(12) United States Patent
Roussell

(10) Patent No.: US 9,957,650 B1
(45) Date of Patent: May 1, 2018

(54) TACTILE SEWING SYSTEM AND METHODS OF USE

(71) Applicant: Tammy L. Roussell, Lowell, MA (US)

(72) Inventor: Tammy L. Roussell, Lowell, MA (US)

( * ) Notice: Subject to any disclaimer, the term of this patent is extended or adjusted under 35 U.S.C. 154(b) by 122 days.

(21) Appl. No.: 15/181,022

(22) Filed: Jun. 13, 2016

Related U.S. Application Data

(60) Provisional application No. 62/175,407, filed on Jun. 14, 2015.

(51) Int. Cl.
*D05B 97/00* (2006.01)
*D05B 97/12* (2006.01)

(52) U.S. Cl.
CPC ..... *D05B 97/12* (2013.01); *D05B 97/00* (2013.01)

(58) Field of Classification Search
CPC ..... D05B 97/12; D05B 97/00
USPC ..... 33/562, 2 R, 17 R, 566
See application file for complete search history.

(56) References Cited

U.S. PATENT DOCUMENTS 2,077,772 A 4/1937 Ring
2,585,946 A 2/1952 Liberman
2,778,114 A * 1/1957 Norman ..... A41F 9/002 2/320
4,053,986 A * 10/1977 Axelrod ..... D04D 7/02 112/475.04
4,064,631 A * 12/1977 Gebert ..... A41H 31/00 33/2 R
4,608,939 A 9/1986 Lampley
4,646,666 A 3/1987 Burrier
4,945,642 A 8/1990 Saulietis
5,791,062 A 8/1998 Walker
6,443,081 B1 * 9/2002 Quint ..... D05B 97/12 112/439
7,568,295 B1 * 8/2009 Strain ..... D05B 97/12 33/1 B
8,186,072 B1 * 5/2012 Nethery ..... D05B 97/12 33/11
2006/0107882 A1 * 5/2006 Gray ..... D05B 35/12 112/117
2007/0220769 A1 * 9/2007 Oehlke ..... D05B 97/12 33/563
2012/0231209 A1 * 9/2012 Grihalva ..... D05B 97/12 428/102

* cited by examiner

*Primary Examiner* — Christopher Fulton
(74) *Attorney, Agent, or Firm* — John J Brooks, III; John Brooks Law LLC

(57) ABSTRACT

The tactile sewing system comprises a plurality of fabric pieces with tactile guides that enable the blind, visually and otherwise impaired to independently hand sew fabric using their sense of touch. The tactile sewing system generally comprises a plurality of fabric pieces, each having a tactile border strip defining a tactile edge of the fabric piece whereby the tactile edge can be used by a user to tactilely guide the sewing of a seam at the edge without the need to visually guide the sewing of the seam. In some embodiments, the tactile sewing system is configured in a kit comprising components such as a needle and thread.

20 Claims, 5 Drawing Sheets

TACTILE SEWING SYSTEM AND METHODS OF USE

CROSS-REFERENCE TO RELATED APPLICATIONS

This application claims the benefit of U.S. App. No. 62/175,407, filed on Jun. 14, 2015, entitled "Mitsy Kit tactile guided sewing and quilting kit for the blind and visually impaired", the entire content of which is incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates to a configuration of kit material to guide the accurate positioning and sewing of fabric pieces. In some embodiments, the materials are particularly configured for use by visually impaired individuals with tactile border strips.

2. Description of the Prior Art

Making quilts from small pieces of fabric arranged in patterns is well known. Common tools to help modern sewers and quilters include sewing machines and aids such as visual templates and guides to help the user with accurate placement of pieces.

Sewing projects such as making a quilt can be complex. For example, a bed quilt sewn from fabric pieces of between 3 and 5 inches can comprise sewing several hundred pieces of fabric together. To ensure the final appearance of the project is pleasing, accuracy of joining the individual fabric pieces is helpful. In larger projects, there are few chances to correct errors which arose while joining pieces early in the project.

There have been many attempts to guide the sewing of fabric to make quilts, some of which have been patented as noted below.

U.S. Pat. No. 4,608,939 (Lampley) discloses a template for hand sewing to ensure equal spacing of stitches.

U.S. Pat. No. 5,791,062 to Walker (Walker) discloses a transparent sheet template that helps the joining and cutting of pieces used to make quilting units.

U.S. Pat. No. 4,646,666 to Burrier (Burrier) discloses a method of making sewn piecework using an overlapping backing material.

U.S. Pat. No. 2,077,772 to Ring (Ring) discloses a patterns to join fabric together at a seam.

However, many of the tools used and developed today are aids that rely on the visual senses or other detailed mental faculties to position and sew the fabric pieces together. The prior art and the patents discussed above do not address problems that are addressed by the embodiments disclosed herein.

SUMMARY OF THE INVENTION

The following summary is included only to introduce some concepts discussed in the Detailed Description below. This summary is not comprehensive and is not intended to delineate the scope of protectable subject matter, which is set forth by the claims presented at the end.

The embodiments of the tactile sewing system and methods disclosed reduce the challenges and disadvantages the prior art present to users that may have a visual or mental impairment. By providing tactile tools and preconfigured arrangements and configurations of fabric pieces, someone with such an impairment can independently position and consistently sew fabric pieces together along the required seam and complete complicated sewing projects. The tactile tools may include tactile border strips along the edges of fabric pieces that help guide the users sewing of the pieces together. The preconfigured arrangement of fabric pieces may comprise preconfiguring sections of a larger project or product pattern into smaller sections of a product map or a product book. By organizing these smaller sections and having tactile tools for organizing these smaller sections into the larger project/product, someone with a visual impairment can accurately position and sew the entire project/product together using their sense of touch in place of eyesight. Similarly, someone with an impairment such as memory impairment can benefit from the simplicity of the tactile sewing system and its methods of use.

In one example embodiment, a tactile sewing system is provided comprising a first fabric piece and a second fabric piece each having at least one attachable edge, a right side and a wrong side. A first tactile border strip is coupled to the wrong side and proximal to at least one attachable edge of the first fabric piece. The first tactile border strip generally covers a portion of the first fabric piece defining a first piece trim section extending along the attachable edge of the first fabric piece. A second tactile border strip is coupled to the wrong side and proximal to at least one attachable edge of the second fabric piece. The second tactile border strip generally covers a portion of the second fabric piece defining a second piece trim section extending along the attachable edge of the second fabric piece. The first piece trim section and the second piece trim section are configured to provide a tactile means for a user to mate the first piece trim section and the second piece trim section to form a joint of a product pattern.

In some embodiments, the tactile sewing system further comprises a tactile indicator coupled to one of the first fabric piece or the second fabric piece whereby a relative orientation of the first and second fabric pieces within the product pattern may be tactilely determined.

In some embodiments, the tactile sewing system further comprises a sewing needle operably coupled to a thread whereby the sewing needle and thread may be tactilely guided by the user to create a sewn seam at the joint.

In some embodiments, the tactile sewing system further comprises a backing material having a backing material tactile border strip extending along an attachable edge of the backing material defining a backing material trim section whereby the backing material is configured to provide a tactile means for a user to mate the backing material trim section and one of the first piece trim section and the second piece trim section to form a joint of the product pattern and the backing material.

In some embodiments, the first and second tactile border strip comprises a first and second set of pre-cut holes and the tactile sewing system further comprises a blunted sewing needle operably coupled to a thread whereby the blunted sewing needle and thread may be tactilely guided by the user through the pre-cut holes to form the joint of the product pattern.

In some embodiments, the tactile sewing system further comprises a first fastener coupling the first fabric piece and the second fabric piece at the attachable edge of the first fabric piece and the attachable edge of the second fabric piece, the first fabric piece and the second fabric piece comprising a first row of fabric pieces and a product book comprising a first book sleeve configured to removably retain the first row of fabric pieces. Some embodiments further comprise a third fabric piece and a fourth fabric piece coupled at an attachable edge of the third fabric piece and an attachable edge of the fourth fabric piece by a second fastener, the third fabric piece and the fourth fabric piece comprising a second row of fabric pieces and a second book sleeve configured to removably retain the second row of fabric pieces.

In some embodiments, the tactile sewing system further comprises a tactile indicator coupled to one or more of the fabric pieces whereby a relative orientation of the fabric pieces within the product pattern may be tactilely determined.

In some embodiments, the tactile sewing system further comprises an organizer configured to provide a placeholder for thread and a set of sewing tools so that they can be held in a location memorable for the user.

In some embodiments, methods of using the tactile sewing systems are also disclosed. Example embodiments of methods of use may comprise using a product map or a product book and corresponding steps to help guide users in sewing according to the product pattern.

In one example embodiment, a tactile sewing kit is provided comprising a first and second fabric piece each having at least one attachable edge, a right side and a wrong side. A tactile border strip is coupled to the wrong side and proximal to at least one attachable edge of the each of the first and second fabric pieces. The tactile border strip generally covers a portion of each fabric piece and defines a trim section extending along the attachable edge of each of the fabric pieces. The trim sections are configured to provide a tactile means for a user to mate the first piece trim section and the second piece trim section to form a joint of a product pattern.

In some embodiments, the tactile sewing kit of further comprises a product book configured to organize a plurality of rows of fabric pieces whereby the rows are aligned according to the product pattern. In some embodiments, the tactile sewing kit further comprises a set of sewing tools and an organizer configured to provide a specific placeholder for the sewing tools.

The advantages and features of the present invention will become apparent to those skilled in the art when the following description is read in conjunction with the attached drawings and the appended claims.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only example embodiments of the invention and are not therefore to be considered to be limiting of its scope, the invention will be described and explained with additional specificity and detail through the use of the accompanying drawings in which.

DETAILED DESCRIPTION OF THE INVENTION

Embodiments of tactile sewing systems, also called the Mitsy Kit, and methods of use will now be described in detail with reference to the accompanying drawings. It will be appreciated that, while the following description focuses on a system that provides sewing systems and guides for making product patterns such as fabric patterns or quilts, the systems and methods disclosed herein have wide applicability. For example and not for limitation, the tactile sewing systems described herein may be readily employed with the making of pillows, handbags, table runners, wall hangings, baby blankets, lap-twin-full-queen-or king size quilts.

Furthermore, although the tactile sewing systems are very helpful for use by users that may have a visual impairment, the tactile sewing systems have also been very helpful to use by users with memory, cognitive and dexterity impairments.

Notwithstanding the specific example embodiments set forth below, all such variations and modifications that would be envisioned by one of ordinary skill in the art are intended to fall within the scope of this disclosure.

One Example Embodiment of a Tactile Sewing System:

The tactile sewing system is an unique configuration of sewing and quilting materials with tactile guides and instructions that enable the blind, visually impaired or otherwise impaired user to independently hand sew or otherwise join fabric using their sense of touch. The tactile sewing system generally comprises a plurality of fabric pieces, each having a tactile border strip defining a tactile edge of the fabric piece whereby the tactile edge can be used by a user to tactilely guide the sewing of a seam with a consistent seam allowance without the need to visually guide the sewing of the seam. In some embodiments, the tactile sewing system is configured in a kit comprising a set of sewing tools such as a needle, thread, pins, pin cushions, wrist pin cushions, small scissors, needle threader, threading assist tools, placeholder markers, and stickers for stabilizing thread when threading.

Figure 1A:
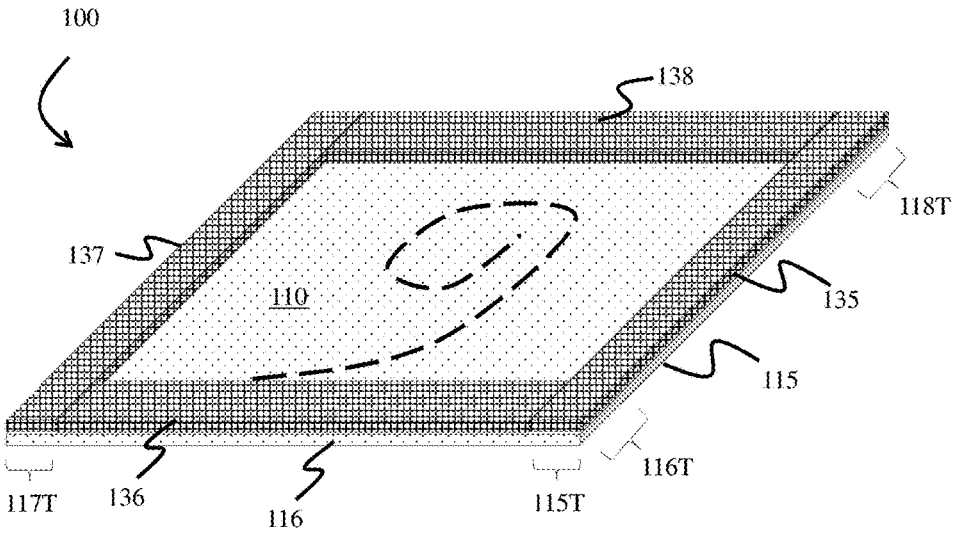
FIG. 1A illustrates a perspective view of the wrong (back) side of one embodiment of a fabric piece with tactile border strips along each of the piece's four edges.
Figure 1B:
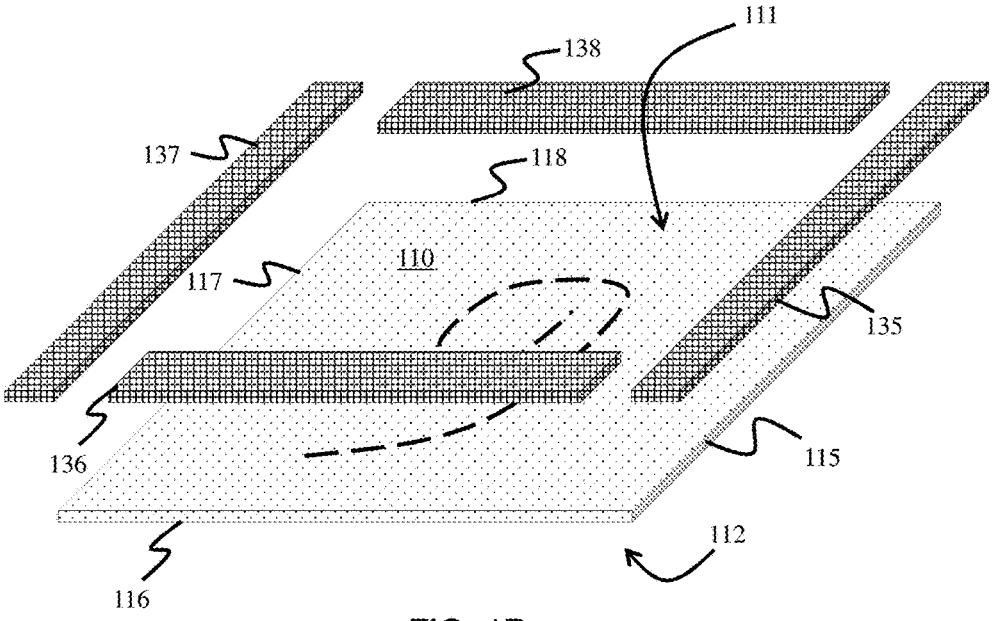
FIG. 1B illustrates an exploded view of the wrong side of the embodiment of FIG. 1A.

For illustration purposes and not for limitation, one embodiment of the present invention is shown in FIGS. 1A-1B. As shown in FIG. 1B, the tactile sewing system comprises a plurality of fabric pieces. Although the fabric pieces may be on any general shape, for illustration purposes, the fabric piece 110 shown is generally rectangular having right (front) side 112, a wrong (back) side 111 and a first, second, third and fourth edge designated 115, 116, 117 and 118 respectively. As shown, the first edge 115 and the third edge 117 have straight portions that are parallel to each other, the second edge 116 and the fourth edge 118 are straight and parallel to each other, and the first edge 115 and second edge 116, and the third edge 117 and fourth edge 118 are disposed perpendicularly to each other. Where the edges are used to be coupled with other edges of other fabric pieces, this defines an attachable edge.

The fabric piece 110 may be any type of fabric or other type of attachable material and may include multiple layers of material. For example and not for limitation, the fabric piece 110 may comprise pre-measured and pre-cut quilt squares, strips, other shaped quilt pieces, quilt backing, and quilt batting.

The tactile sewing system also comprises one or more tactile border strips configured to provide a tactile guide for the user to follow when sewing together the pieces in the kit. The tactile border strip provides a tactile guide for the user to follow when sewing together the pieces in the kit. Referring to FIG. 1B, the tactile border strips, here four 135, 136, 137 and 138 correspond to each of four attachable edges of the fabric piece 110. The tactile border strips are coupled to the wrong side of and proximal to at least one attachable edge of the first fabric piece 110. The tactile border strips provide a user who is blind, visually impaired or otherwise impaired to orient and locate portions of the fabric pieces without the need to visually guide the positioning of fabric pieces and the sewing of the seam.

The tactile border strip may be any material or an absence of material that will provide a tactilely different feel to a user from the feel of the fabric pieces. For example and not for limitation, the tactile border strip may comprise a textured ribbon, burlap, plastic, paper, a tactile border produced by painting or printing processes, or any other material that can be attached, adhered or otherwise coupled to the fabric pieces to serve as a tactile reference for a user. The tactile border strip may be a textured fabric ribbon sewn along the borders of the fabric pieces to support the production of a particular quilting, sewing or fabric crafting project. Dimensions of the tactile border strip may be any dimension to provide a suitable tactile reference to a user. In some embodiments, the tactile border strip comprises a ⅜" burlap fabric ribbon positioned along the edges of the fabric piece. In some embodiments the tactile border strip may comprise a tactile substance painted or printed around the edges of the fabric pieces or any other tactile substances applied to the fabric pieces to function as the tactile border strip. In some embodiments, the tactile border strip may be removably coupled to the fabric pieces. In some embodiments, the fabric pieces may be provided without the tactile border strips and the tactile border strips may be coupled to the fabric pieces prior to use by the impaired user.

In some embodiments, the tactile border strip may comprise pre-cut holes in the fabric along a seam border. The pre-cut holes may also have a tactile substance applied around the edges of the pre-cut holes, such as a liquid paint that hardens on the fabric when dry, to further enhance the tactile features of the pre-cut holes. In addition to guiding the user to the border of the fabric pieces, the pre-cut holes enable the use of a blunted needle for stitching a project together in place of a traditional sewing needle.

To facilitate use of the tactile border strip with the fabric piece, the tactile border strip or the fabric piece may be further designated with tactile indicators representing additional characteristics of the tactile border strip or fabric piece. For example, and not for limitation, tactile indicators may be provided to designate measurements of the fabric piece, sequence of the fabric pieces in a product pattern, fabric colors or fabric piece orientation to the product pattern.

In some embodiments, the tactile sewing system also comprises a sewing needle. The sewing needle is configured to be operably coupled to a thread whereby the sewing needle and thread may be tactilely guided by the user to create a sewn seam at the joint. Embodiments of the needle may comprise a traditional sewing needle and some embodiments may comprise a blunted sewing needle, such as a blunted plastic needle. The blunted sewing needle is typically not configured to puncture the fabric but is configured to be used when pre-cut holes are placed about the borders of the fabric pieces. The blunted sewing needle is configured to weave through the pre-cut holes to join the fabric pieces at the seam while reducing the risk of the user being punctured with a sharper needle.

In some embodiments, a tactile indicator is coupled to one of the first fabric piece or the second fabric piece whereby a relative orientation of the fabric piece within the product pattern may be tactilely determined. For example and not for limitation, a tactile indicator may be provided that indicates the location of that fabric piece within the product pattern such as the location within a row of fabric pieces. The tactile indicator may be any type of indicator that can be temporarily or permanently coupled to the fabric pieces as indicators of directional orientation. For example, and not for limitation, a tactile indicator may be a sticker, a sticky back felt piece or a piece of hook and loop fastener.

Referring to FIG. 1A, the tactile border strip is configured to generally cover a portion of the first fabric piece and together the strip and portion of the fabric piece define a first piece trim section extending along the attachable edge of the first fabric piece. As shown, the tactile border strip is preferably positioned on the attachable edge of the fabric piece, and the four tactile border strips, are positioned on the attachable edges (here four) of the fabric piece. Examples of trim sections are shown as a first trim section 115T which generally aligns along the first edge 115 for the width of the tactile border strip 135. For the other edges of the fabric piece 110 there are other trim sections such as a second trim section 116T generally aligning with the second edge 116, a third trim section 117T generally aligning with the third edge 117 and a fourth trim section 118T generally aligning with the fourth edge 118.

Figure 2A:
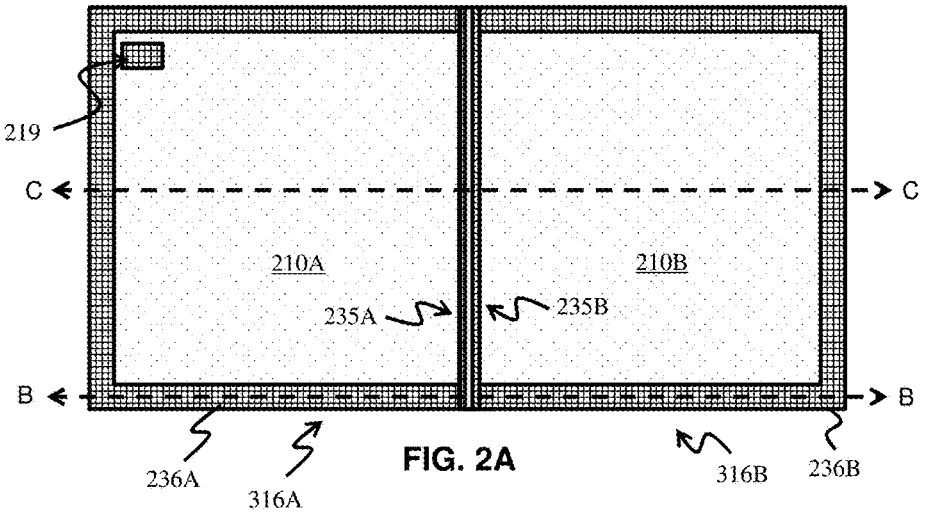
FIG. 2A shows a wrong side view of one embodiment of two fabric pieces joined at a joint along one edge of the two fabric pieces.
Figure 2B:
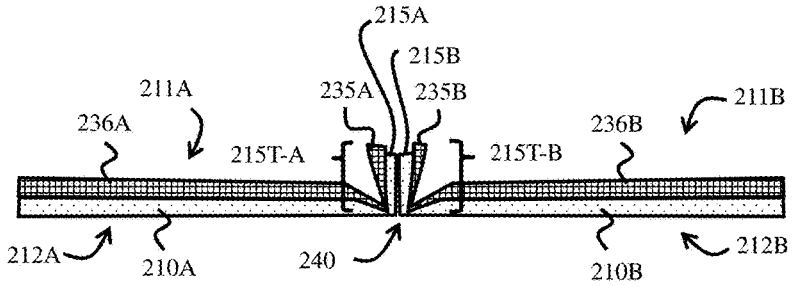
FIG. 2B shows a side view of FIG. 2A, along a cut-away shown as B-B of FIG. 2A, as they may be positioned after sewing of seam for a joint.

One of the benefits of the configuration of the tactile border strips and fabric pieces is shown in FIGS. 2A-2D. As shown in FIG. 2A, two fabric pieces 210A and 210B are shown each with tactile border strips coupled to the wrong side and proximal to at least one attachable edge of the fabric pieces. At the attachable edges (for example 316A and 316B), each of the tactile border strips (236A and 236B) generally define a trim section extending along the attachable edge of each of the fabric pieces. These trim section of the fabric pieces provide a tactile means for a user to mate the first piece trim section and the second piece trim section to form a joint of a larger product pattern (such as a fabric pattern or quilt) whereby the sewing needle and thread may be tactilely guided by the user to create a sewn seam at the joint. FIG. 2A also shows an example embodiment of a tactile indicator 219 on the top left hand corner of the fabric piece 210A. FIG. 2B shows this in detail with a side view of the embodiment of FIG. 2A with a cut-away along line B-B. As shown, the first attachable edges (215A and 215B) of the first and second fabric piece (210A and 210B) are mated on their right sides (212A and 212B) forming a joint 241 on the right side of the joined fabric piece with the two trim section (215T-A and 215T-B) further being folded into and extending into the wrong sides (211A and 211B) of the fabric pieces (210A and 210B). At the seam 240, preferably positioned at the inside edge of the tactile border strips, the user can use the needle and thread to sew a seam to create the joint 240. Because the joint 240 is below or within the tactile border strips (235A and 235B), the user can feel the edges of the tactile border strips and can therefore position the seam in the appropriate place.

Another benefit of the configuration of the tactile border strips and fabric pieces is that the user can identify the right side from the wrong side of the fabric, since the tactile border strips will preferably be coupled on the wrong side of the fabric and the right sides of the fabric will be smooth without tactile border strips.

Figure 2C:
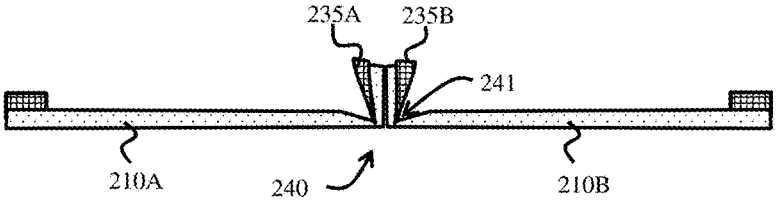
FIG. 2C shows a side view of FIG. 2A, along a cut-away shown as C-C of FIG. 2A, as they may be positioned after sewing of a seam.

FIG. 2C shows another side view of the embodiment of FIG. 2A with a cut-away along line C-C. This view clearly shows the inside edge (facing the center of the fabric piece) of the tactile border strips (235A and 235B) defining the positioning of the seam 241 at the joint 240.

Figure 2D:
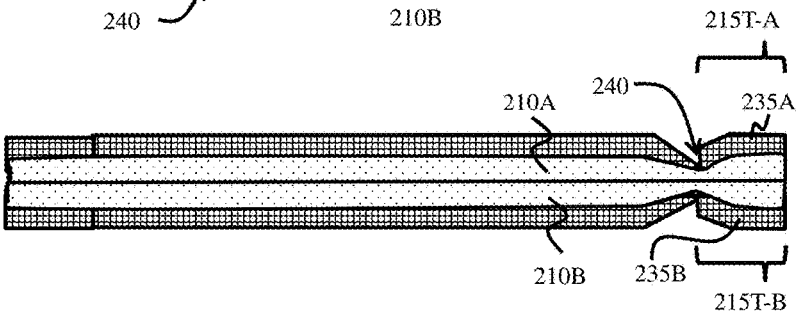
FIG. 2D shows a side view of two fabric pieces, along a section of fabric pieces consistent with the cut-away shown as C-C of FIG. 2A, as they may be positioned for sewing of a joint.

FIG. 2D shows another side view of the of the embodiment of FIG. 2A with a cut-away along line C-C. This illustration shows the first and second fabric pieces (210A and 210B) folded over each other with their right sides facing each other as they would be positioned when sewing the pieces together at the joint 240.

In some embodiments, the tactile sewing system further comprises additional organizational tools such as a product map and/or a product book.

Figure 3A:
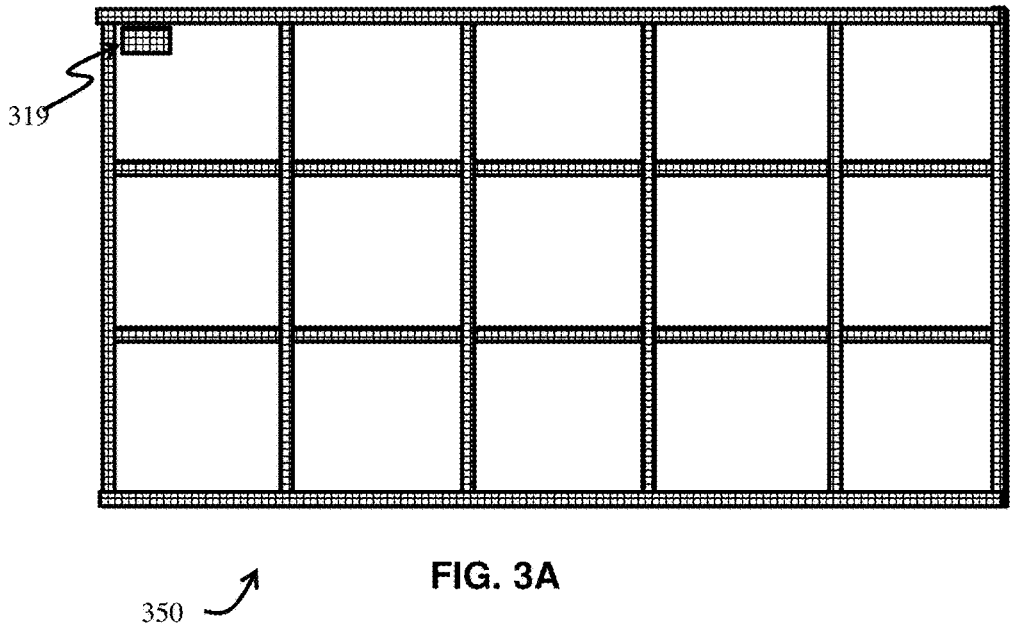
FIG. 3A shows a top view of an example embodiment of a quilt product map.

FIG. 3A illustrates one embodiment of a product map. The product map 350 reflects the final positioning of the fabric pieces and can be used to tactilely guide the correct sequencing and directionality of fabric pieces to produce the desired product pattern without requiring eyesight. In one embodiment, the product map includes a single sheet of fabric or other material with tactile border strips or markings forming a grid of rows and columns. Fasteners may be provided to temporarily hold the fabric pieces in proper place or position. As used herein, fasteners may include, but are limited to, hook and loop fastener strips (such as Velcro®). safety pins, tape, clips or any other type of temporary attachment or coupling device. The product map may be used to align or place the fabric pieces to help guide the user to create the final product pattern. The layout of the product map, or the fabric pieces in the product map will visually and tactilely represent the correct order, sequencing, and directionality of fabric pieces in order to produce the recommended product pattern. The product map may have other tactile markings or tactile indicators (see 319) on the map to help guide the user to the correct positioning of the fabric pieces. The fabric pieces may also have fasteners, such as hook and loop or other fasteners, on one of their sides to allow easy attachment and detachment of fabric pieces from the product map. Audio and video instructions may also be provided to help guide the use to appropriately use the product map, with or without the help of a sighted guide.

Figure 3B:
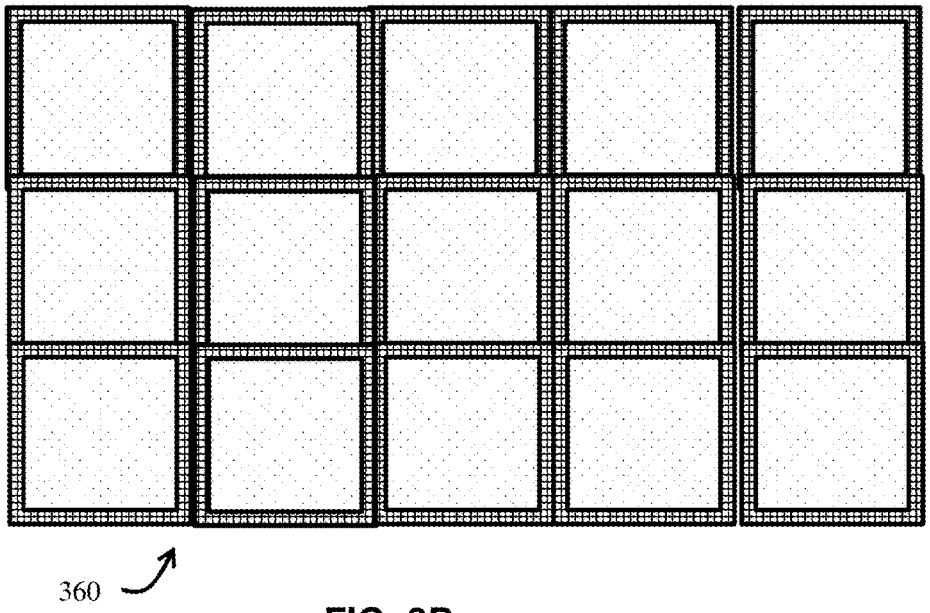
FIG. 3B shows a top view of an example embodiment of a quilt product map showing the fabric pieces laid out on the product map as they would be positioned in a final product pattern.

FIG. 3B illustrates one embodiment of a final product pattern 360, from the wrong side, of a set of fabric pieces aligned and sewn together according to the product map 350 of FIG. 3A.

Figure 4A:
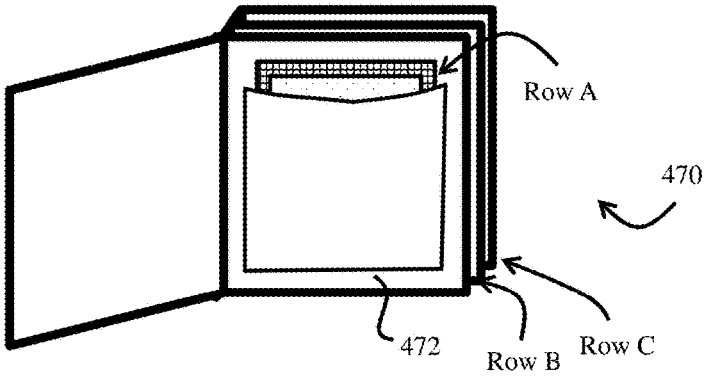
FIG. 4A shows a top view of an example embodiment of a tactile sewing system configured as in a product book.

FIG. 4A illustrates one embodiment of a product book. The product book 470 comprises a fillable book 472, such as a notebook, containing preconfigured rows of fabric pieces as they would be positioned in a product map or in the final product pattern. As shown, Row A represents a "page", or sleeve, of the book and includes one preconfigured row of fabric pieces (see FIG. 4B). Row B and Row C are other rows of preconfigured fabric pieces and are contained on separate pages or sleeves of the book. The rows of fabric pieces are removably coupled to each other through the use of fasteners such as but not limited to, hook and loop fasteners, safety pins, tape, clips or other similar removable fastening device. The organization from the product book allows a user to work on a limited number of fabric pieces, such as one section, or one row of the product pattern while keeping the other pieces/sections/rows organized. The product book 470 also helps provide a guide as to the sequence that the sections/rows are attached to make the product pattern.

In some embodiments, optional labels may be provided on the fabric pieces. For example, audio bar code labels may also be made available on fabric pieces to enable the sewer/quilter to use an audio bar code reader to identify the colors and patterns of quilt pieces. The audio label descriptions of fabric pieces will correspond with those which can be reviewed and selected via an audio or video inventory of quilt pieces. The inventory of quilt pieces may be made available through a direct or indirect link to a Mitsy Kit website. This option is to enable more creativity for a sewer/quilter to produce their own product pattern by selecting fabric piece colors and patterns independently and then placing and ordering selected pieces on a quilt map to produce their desired combination/pattern. Tactile labels such as raised letter or braille markings may also be provided.

Figure 4B:
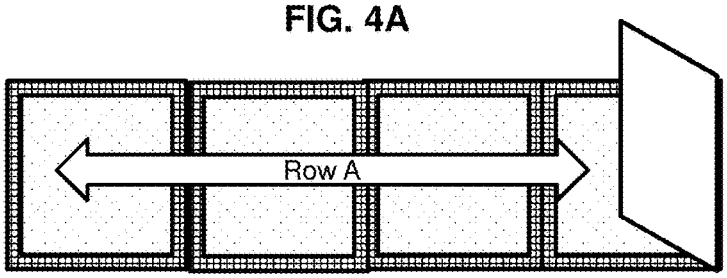
FIG. 4B shows a top view of an example embodiment of a row of fabric pieces.
Figure 4C:
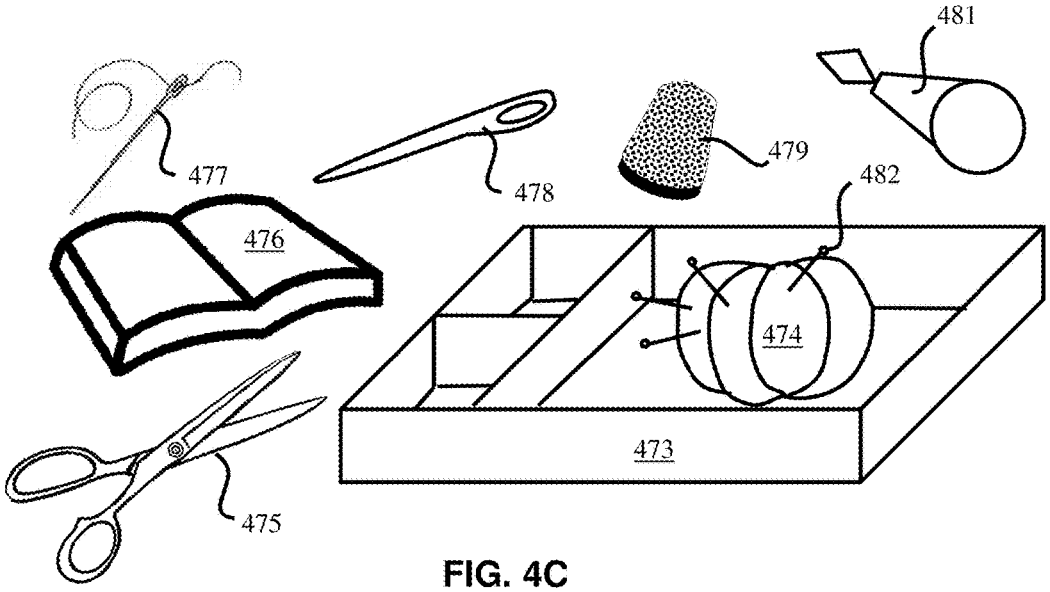
FIG. 4C shows a top perspective view of example components of a tactile sewing system when the tactile sewing system is configured as a kit.

FIGS. 4A-4C also illustrate an embodiment of a tactile sewing system configured as a tactile sewing kit. The tactile sewing kit may contain the elements described in the embodiments herein with a product book. Embodiments of the tactile sewing kit may provide additional sewing and quilting materials, pre-measured and pre-cut fabric pieces, tactile border strips and other tactile guides and tactile indicators needed to produce product patterns such as quilts. FIG. 4C illustrates some examples of other optional kit accessories that may be included in a kit include a pin cushion 474, an instruction book 476, a thimble 479, small scissors 475 for cutting thread, a larger than average needle threader 481, sewing needles and thread 477 with large enough eyes to be easily threaded with the needle threader 481, blunted sewing needles 478 and a supply of round headed pins 482. Other examples of optional kit accessories that may be included in a kit include a seam ripper, a rubber needle gripper, thread wax, thread waxing containers, placeholder clips, blunted plastic sewing needles and sticky labels that are used to stabilize thread when placing through diamond in the needle threader. Another optional kit accessory that may be included in a kit include an organizer 473 that provides a specific placeholder for all the sewing/quilting tools and accessories so that everything is easily found without sight by memory of proper placement. The organizer 473 may also provide a specific placeholder for thread that enables the thread to be located tactilely and keeps the thread spool from rolling away while unwinding thread. The organizer may also include options to purchase and hold the optional kit accessories listed above. The organizer may also include small clothes pins to be used as placeholders to pin on fabric pieces where one has stopped sewing temporarily so that they can easily find where they left off when they come back to their project.

In some embodiments, as shown in FIGS. 1A-1B, an additional product option includes a raised puffy paint outline or other raised print outline on the wrong side of the fabric material which can be used to guide hand quilted stitching patterns on individual fabric pieces.

Figure 5:
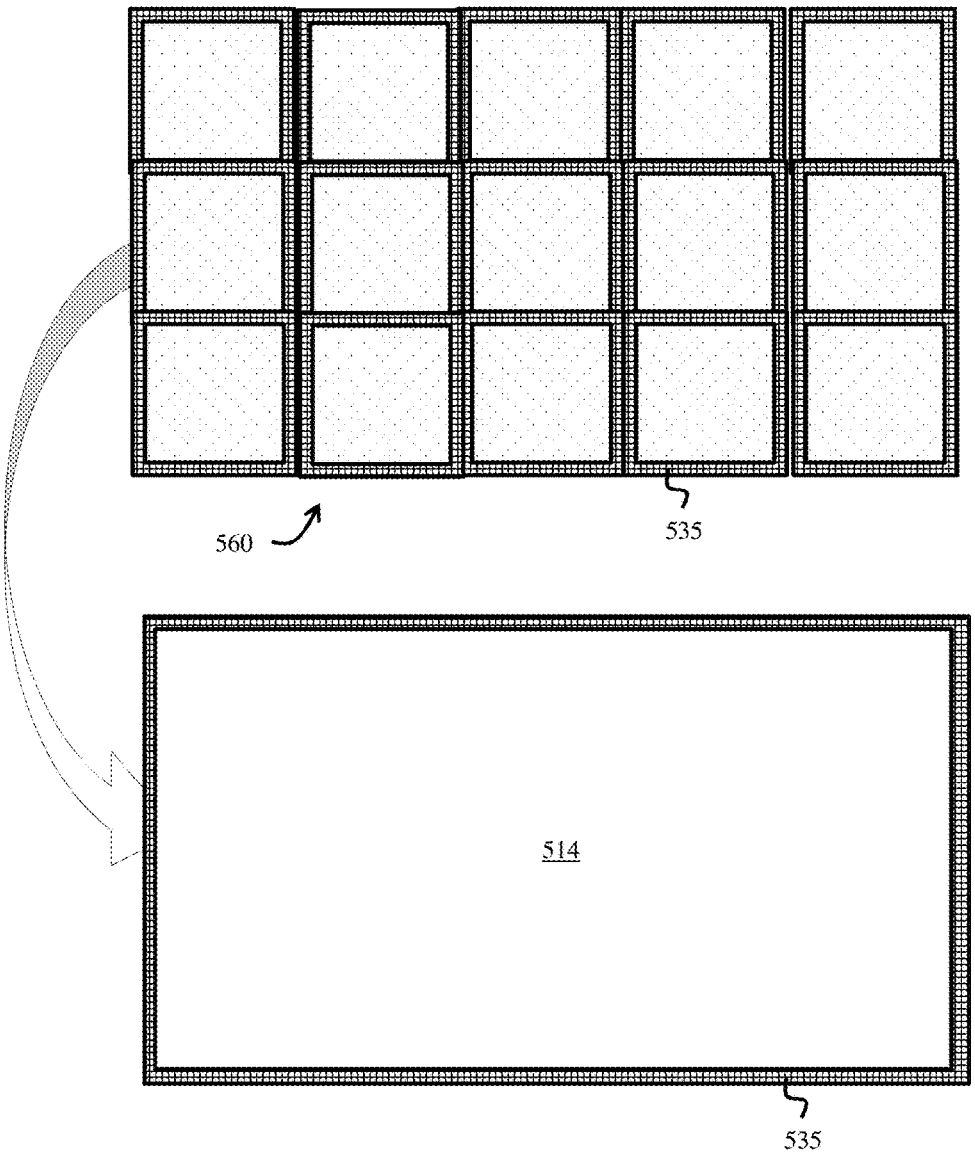
FIG. 5 shows a view of an example embodiment of a tactile sewing system having a backing material to be coupled to the sewn fabric pieces.

In some embodiments a backing material may also be provided. The backing material is configured to be a backing for the product pattern and as such is generally as large as the entire product pattern. As shown in FIG. 5, the backing material 514 may have a backing material tactile border strip 535 positioned on the attachable edges similar to the configuration of the tactile border strip of the fabric piece and defining a backing material trim section. The backing material tactile border strip 535 of the backing material 515 is configured to be aligned and mated with the outside tactile border strips (here 535) of the sewn product pattern 560 whereby the attachable edges of both the backing material and the product pattern provide a tactile means for a user to mate the backing material trim section and one of the first piece trim section and the second piece trim section to form a joint of the product pattern and the backing material at the outside trim sections by sewing or similar means. Since the final product pattern will be turned inside out after sewing, the sides of the sewn product pattern 560 and the backing material 514 with the tactile sides exposed on the outside of the material when they are "sandwiched" together for sewing. When coupled, the finished product pattern may be turned inside out through an unsewn portion of the product pattern to expose the right side of the product pattern and hide the wrong side of the material pieces and the tactile border strips.

In some embodiments a batting material may also be provided in addition to the backing material. For those embodiments, the batting material may be coupled, such as pinned, to the wrong side of the backing material—and may or may not have the tactile border strips sewn to the four sides of the batting material. It is possible not to include the tactile border on the batting because the wrong side of the product pattern will already have the tactile border strips on all four outer edges and those strips can be used as the tactile sewing guide after being pinned right side down facing right side of backing material. Together, the backing and batting material are configured to have a backing and batting material tactile border strip extending along an attachable edge of the backing and batting material. The backing and batting material tactile border strip defines a backing and batting material trim section whereby the backing and batting material trim section provides a tactile means for a user to mate the backing and batting material trim section and one of the first piece trim section and the second piece trim section to form a joint of the product pattern with the backing and batting material.

One Example Embodiment of Methods of Using the Tactile Sewing System:

The methods of using one embodiment of the tactile sewing system will now be briefly described referring to the embodiment shown of a tactile sewing system including a product book as shown in FIG. 4. Although the description below illustrates use of fabric pieces that make up a quilt as a product pattern, this is for illustration purposes only. It is understood that the methods may be used with other fabric pieces to make other product patterns. Furthermore, although the descriptions may describe methods benefiting users with visual impairments, the methods have been found to also benefit users with other impairments such as memory or cognitive impairments.

After being provided a tactile sewing system consistent with the embodiments described herein, the methods of use generally comprise the steps described below. The user should determine the layout of the product pattern through a series of steps including the following:

Step 1: Position and orient the product map on flat surface with a tactile indicator of the product map or fabric pieces, such as a burlap tab in the upper left corner.

Step 2: Identify a row of fabric pieces on the product map designated by a tactile strip running horizontally under the plurality of fabric pieces.

Step 3: Identify the number of columns of fabric pieces on the product map designated by the number of fabric pieces across the top of the product map. This may be done by the user running their fingers along top row of product map and feel the number of fabric pieces from left to right. This is the number of fabric pieces that will complete the first row of fabric pieces in the product pattern.

Optionally, the user may continue down the product map going down each row and across left to right with fingers to feel all of the fabric pieces in each row of fabric pieces in the product pattern.

Optionally, the user may note the fasteners running vertically along the product map; the fabric pieces are coupled to these fasteners by coupling them to a mating fastener on one side of each fabric piece.

Step 4: Identify a right side of the fabric piece as smooth and facing up on the product map. The user should note that the right side of the fabric piece material is smooth and facing up on the product map.

Step 5: Identify a wrong side of the fabric piece. The wrong side of the fabric piece material having a tactile border strip and is facing down on the product map.

Next, the user positions and starts to sew the fabric pieces of a row together. This part of the process includes the following steps:

Step 6: Position and sew the first row of fabric pieces on top of the product map, starting with the first two fabric pieces in the row of fabric pieces. This step 6 is done by the following sub-steps 6a-6g.

Step 6a: Fold the subsequent fabric piece over the prior fabric piece in the row by folding the second fabric piece over the first fabric piece like a page in a book (vertically and left).

Step 6b: Confirm the right sides of the first and second fabric pieces are facing each other and the wrong sides should be facing outward.

Step 6c: Remove the first and second fabric pieces from the product map.

Step 6d: Position the first and second fabric pieces counter clockwise ninety degrees so that the fastener on each fabric piece is along the top of the first and second fabric pieces.

Step 6e: Position and pin the first and second fabric pieces together from left to right corners and hand stitching just under the tactile border strip, representing the inside edge of the tactile border strip, from a corner of the joined first and second fabric pieces to another corner of the joined first and second fabric pieces.

Step 6f: Unfold the first and second fabric pieces and turn them over so the right side of the fabric piece is facing up, and rotate clockwise ninety degrees so that the wrong sides with the fastener is on the right of the first and second fabric pieces.

Step 6g: Reattach the sewn row of fabric pieces to the product map by the fastener of the right most fabric piece to the area of the product map from which it originated.

Step 7: Continue sewing the remaining fabric pieces in the row of fabric pieces by following steps 6a-6g until all the fabric pieces in the row are sewn together and attach the sewn row to the product map by the fastener of the right most piece.

Next, the user positions and completes sewing the fabric pieces of rows together. This part of the process includes the following steps:

Step 8: Sew the rows together starting with the top two rows. Step 8 is done by the following sub-steps 8a-8e.

Step 8a: Fold the bottom side of the subsequent row of fabric pieces up and over the previous row of fabric pieces to align with the top side of the prior row so that the right sides of the two rows of fabric pieces are together and the wrong sides are facing outward.

Step 8b: Remove these rows of fabric pieces from the product map.

Step 8c: Position and pin the bottom sides of the rows of fabric pieces together from left to right corners of each of the fabric pieces in the row, then hand stitch just under the tactile border strip of the bottom sides of first to last fabric pieces in the row of fabric pieces.

Step 8d: Once sewing is completed, unfold the rows of fabric so the right side of the fabric piece is facing up, and the wrong sides with the tactile border strips are facing down and the fastener attachment is on the right of fabric pieces.

Step 8e: Attach the fastener from the right most piece of the first row to the area of the product map from which it originated. (The fastener location on the right sides of each quilt piece validates that you have the quilt pieces and rows in the right directionality.)

Step 9: Continue sewing the remaining rows together by following steps 8a-8e until all the rows of fabric pieces are sewn together. This completes your product pattern, such as a quilt face.

An alternative method of using the tactile sewing system generally comprises using a product book to help preconfigure fabric pieces and organize the orientation of the fabric pieces within the product pattern. With the product book, each project may be packaged or otherwise removably retained in book sleeves with each book sleeve corresponding to a portion of the product pattern. In this example embodiment, each of the book sleeves contains a row of preconfigured fabric pieces in the product pattern much like the row of fabric pieces in FIG. 4B. It is understood that the following steps are an example embodiment and should not be considered all inclusive, as other projects may involve just one project book sleeve to sew two pieces of fabric together versus multiple rows of fabric. In some embodiments, each project will have its own set of audio and video instructions to enable project users to follow instructions to complete their product pattern.

In this illustrative embodiment, the methods of use with the product book start by being provided a tactile sewing system having a product book consistent with the embodiments described herein. In the product book, the first book sleeve of the product book is typically configured to contain all fabric pieces comprising row one of the product pattern, the second book sleeve of the product book will contain all fabric pieces comprising row two of the product pattern, and so on until all of the row are contained in a book sleeve. In addition to the book sleeves containing the preconfigured row of fabric pieces, a book sleeve of the product book may contain additional project accessories like buttons, ribbons, backing, and or batting pieces to help the sewer/quilter finish the product pattern. Each of the fabric pieces in the book sleeve may be fastened together along its attachable edge with its adjacent fabric piece with fasteners (such as safety pins, tape, clips, or other fasteners) in the correct order and directionality to guide the sewing order and produce the desired sewing/quilting product pattern result. There may also be some tactile identifier or tactile indicator in the form of a tactile sticker, sticky back felt piece, tape, or other tactile indicator, which may be coupled to one of the fabric pieces in a specific location. The tactile indicator may be permanently adhered to or otherwise coupled to the fabric piece or the tactile indicator may be temporarily coupled to the fabric piece. This tactile indicator identifies a characteristic of this fabric piece such as an identifier that this fabric piece should be in a specific sequence in the row or product pattern. For example, the tactile indicator may be in the upper left corner of the fabric piece and this helps to identify the correct orientation of the fabric pieces from left to right in the product pattern. In one example embodiment, these tactile indicators are all on the left most pieces until all the project rows are sewn together and this placement guides alignment of all left most pieces one on top of another in the product pattern.

After being provided a tactile sewing system having a product book, one embodiment of the steps for sewing project pieces in product notebook comprise:

Step 1: Remove the fabric pieces from the book sleeve in the product book. (This will be the first book sleeve if just beginning the product pattern or it will be the next book sleeve if the user is coming from completing Step 8 below.)

Step 2: Orient the first row of fabric pieces within the larger product pattern using the tactile indicator and placing the fabric pieces whereby the wrong side of the fabric pieces are facing downward toward the surface. The fabric pieces may be preconfigured so that the user should be able to feel for the tactile indicator on the fabric pieces and orient the fabric pieces as instructed. For example, if the tactile indicator is to be in the left hand corner of the first piece in the row, the user locates the tactile indicator and orients that fabric piece so that it is the left most fabric piece. The user should then feel for the tactile border on all attachable edges of the wrong side of the fabric pieces and place the fabric pieces so that the wrong side of the fabric is facing downward toward a surface such as the surface of the table.

Step 3: Fold over the right most fabric piece onto the right side of its adjacent fabric piece, so that the wrong side of the last fabric piece is facing upward.

Step 4: Reorient the fabric pieces in a top down columnar format whereby the fabric pieces that were on the right side are now be the top most fabric pieces in the column. This may be done by turning the row of fabric pieces counterclockwise until the fabric pieces are positioned in a top down columnar format whereby the fabric pieces that were previously on the user's right side should now be the top most fabric pieces in the column.

Step 5: Pin the top two pieces of fabric together from corner to corner with pins through the tactile borders to secure in place before sewing. This step is generally pinning the trim sections of the fabric pieces to be sewn. The user may choose to remove the fasteners coupling the fabric pieces after they have pinned the pieces together with straight pins.

Step 6: Either on the far left or far right—depending on sewing direction preference—put the threaded sewing needle through the fabric pieces just inside the corner intersection of the tactile borders strips and begin stitching (running and some back stitch) from right to left or left to right, continuing just under (alongside) the tactile border strip joining the two pieces of fabric and creating the appropriate seam allowance as guided by the tactile border. When complete stitching from corner to corner, tie-off the stitches and cut the thread.

Step 7: If there are other fabric pieces below the two fabric pieces previously sewn together, the user will sew the remainder of fabric pieces in the column together with the following steps (7a-7c):

Step 7a: Fold the fabric piece on the bottom (towards the surface) of the two pieces just sewn in the prior step, up from the surface, towards the bottom of the column and on top of the adjacent fabric piece in its column so that the wrong side of this fabric piece is facing upward and on top of the adjacent fabric piece in that column.

Step 7b: Follow steps 5 and 6 to stitch these two fabric pieces together.

Step 7c: Continue Steps 7a-7b until all remaining fabric pieces in the column are sewn together.

Step 8: Once completed sewing all fabric pieces in the product book sleeve, put the sewn row of fabric pieces back into the product book sleeve and move on to next book sleeve in the product book.

Step 9: Follow steps 1-8 for the remaining product book sleeves until all rows of fabric pieces in the product pattern are sewn.

Step 10: Remove the sewn fabric pieces from the product book first sleeve and set the row on a surface with the tactile indicator aligned properly. In this example, the tactile indicator should be on most left hand piece of fabric and the wrong side of the fabric pieces should face the surface.

Step 11. Remove the sewn fabric pieces from next product book sleeve and set the row of fabric pieces on the surface adjacent to and underneath the fabric pieces from prior product book sleeve with the tactile indicator aligned properly, for example on most left hand piece of fabric, and the wrong side of fabric pieces facing the surface.

Step 12. Flip the bottom side of the last row up and over so that the attachable edges align with the attachable edges of the top side of the prior row. This should position the right sides of the two rows of fabric pieces facing each other and the wrong sides are facing outward with the tactile border strips facing outward and towards the surface.

Step 13: Align and pin the bottom sides of both rows of fabric pieces together from left to right corners of each of the fabric pieces in the row. This step is generally pinning the trim sections of the rows of fabric pieces to be sewn together. Then stitch just inside the tactile border strip of the bottom sides of first to last fabric pieces in the row of fabric pieces.

Step 14: Once sewing is completed in step 12, unfold the rows of fabric pieces so the right side of the material is facing up, and the wrong sides are facing down with the tactile indicator still on the left most piece of the rows.

Step 15: Continue sewing the remaining rows together by following steps 10-14 until all the rows of fabric pieces are sewn together. This completes the right side of your product pattern.

In some embodiments a backing material may also be provided. The backing material is configured to be a backing for the product pattern and as such is generally as large as the entire product pattern. The backing material is sewn onto the sewn fabric pieces by positioning the outside tactile border strips of the sewn product pattern with the outside tactile border strips of the backing material whereby the attachable edges of both the backing material and the product pattern may be coupled at a joint of outside trim sections by sewing. After they are sewn together, the finished product pattern may be turned inside out through an unsewn portion of the product pattern to expose the right side of the product pattern and hide the wrong side of the material pieces and the tactile border strips.

In some embodiments a batting material may also be provided in addition to the backing material. For embodiments with backing and batting material, the batting material will be pinned to the wrong side of the backing material or the fabric pieces and the batting material will be sewn into the product pattern between the backing material and the fabric pieces.

In some embodiments, audio instructions may be provided that enable the blind and visually impaired to independently hand sew and quilt using their sense of touch.

Although this invention has been described in the above forms with a certain degree of particularity, it is understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention which is defined in the claims and their equivalents.

I claim:

1. A tactile sewing system to tactilely guide a user to create a joint of a product pattern, said tactile sewing system comprises:

a first fabric piece and a second fabric piece each having at least one attachable edge, a right side and a wrong side;

a first tactile border strip and a second tactile border strip;

the first tactile border strip coupled to the wrong side and proximal to the at least one attachable edge of the first fabric piece;

the first tactile border strip generally covering a portion of the first fabric piece and together defining a first piece trim section extending along the at least one attachable edge of the first fabric piece;

the second tactile border strip coupled to the wrong side and proximal to the at least one attachable edge of the second fabric piece;

the second tactile border strip generally covering a portion of the second fabric piece and together defining a second piece trim section extending along the at least one attachable edge of the second fabric piece; and the first piece trim section and the second piece trim section configured to provide a tactile means for a user to mate the first piece trim section and the second piece trim section to form a joint of a product pattern.

2. The tactile sewing system of claim 1 further comprising a tactile indicator coupled to one of the first fabric piece or the second fabric piece whereby a relative orientation of the first and second fabric pieces within the product pattern may be tactilely determined.

3. The tactile sewing system of claim 1 further comprising a sewing needle operably coupled to a thread whereby the sewing needle and the thread may be tactilely guided by the user to create a sewn seam at the joint.

4. The tactile sewing system of claim 1 wherein the first and the second tactile border strip comprises a burlap fabric ribbon.

5. The tactile sewing system of claim 1 wherein:

the first fabric piece and the second fabric piece each comprise a rectangle shape; and the at least one attachable edge comprises four attachable edges.

6. The tactile sewing system of claim 1 further comprising:

a backing material having a backing material tactile border strip extending along an attachable edge of the backing material defining a backing material trim section whereby the backing material is configured to provide a tactile means for the user to mate the backing material trim section and one of the first piece trim section and the second piece trim section to form a joint of the product pattern and the backing material.

7. The tactile sewing system of claim 1 further comprising:

a backing and batting material having a backing or batting material tactile border strip extending along a attachable edge of the backing and batting material defining a backing and batting material trim section whereby the backing and batting material trim section is configured to provide a tactile means for the user to mate the backing and batting material trim section and one of the first piece trim section and the second piece trim section to form a joint of the product pattern and the backing and batting material.

8. The tactile sewing system of claim 1 further comprising an audio bar code label on the first or second fabric piece whereby the user can use an audio bar code reader to identify colors or a pattern of the first or second fabric piece.

9. The tactile sewing system of claim 1 further comprising a product book configured to organize a plurality of rows of fabric pieces whereby the rows are aligned according to a product map.

10. The tactile sewing system of claim 1 wherein:

the first tactile border strip comprises a first pre-cut hole;

the second tactile border strip comprises a second pre-cut hole; and the tactile sewing system further comprises a blunted sewing needle operably coupled to a thread whereby the blunted sewing needle and the thread may be tactilely guided by the user through the first and second pre-cut holes to form the joint of the product pattern.

11. A method of using the tactile sewing system of claim 1, the method comprising:

(1) positioning a product map on a flat surface with a tactile indicator in an upper left corner wherein the product map comprises a plurality of fabric pieces including the first fabric piece and the second fabric piece and the plurality of fabric pieces are coupled to at least one hook and loop fastener strip running vertically along the product map by a hook and loop fastener on the right hand side of each fabric piece;

(2) identifying a row of fabric pieces on the product map designated by a tactile strip running horizontally under the plurality of fabric pieces;

(3) identifying a number of columns of fabric pieces on the product map designated by a number of fabric pieces across the top of the product map;

(4) identifying a right side of the plurality of fabric pieces as smooth and facing up on the product map;

(5) identifying a wrong side of the plurality of fabric pieces as having the tactile border strip and the hook and loop fastener and as facing down on the product map; and (6) positioning and sewing a first row of fabric pieces on a top side of the product map, starting with the first fabric piece and the second fabric piece in the row of fabric pieces by:

(6a) folding the first fabric piece over the second fabric piece in the row of fabric pieces by folding the second fabric piece over the first fabric piece like a page in a book (vertically and left), (6b) confirming the right sides of the first and second fabric pieces are facing each other and the wrong sides should be facing outward, (6c) removing the first and second fabric pieces from the product map, (6d) positioning the first and second fabric pieces counter clockwise ninety degrees so that the hook and loop fastener on each piece is along the top of the first and second fabric pieces, (6e) positioning and pinning the first and second fabric pieces together from left to right corners and hand stitching just under the tactile border strip, representing an inside edge of the tactile border strip, from a corner of the joined first and second fabric pieces to another corner of the joined first and second fabric pieces, (6f) unfolding the first and second fabric pieces and turn them over so the right side of the fabric piece is facing up, and rotate clockwise ninety degrees so that the wrong sides with the hook and loop fasteners are on the right of the first and second fabric pieces, and (6g) reattaching the sewn row of fabric pieces to the product map by the hook and loop fastener of the right most fabric piece.

12. The method of claim 11 further comprising:

(7) sewing a third fabric piece and a fourth fabric piece as a second row of fabric pieces by following steps 6a-6g;

(8) sewing the first and second rows of fabric pieces together by:

(8a) folding a bottom side of the second row of fabric pieces up and over the first row of fabric pieces to align with a top side of the first row of fabric pieces so that the right sides of the two rows of fabric pieces are together and the wrong sides are facing outward, and the hook and loop fasteners are on the right borders of each fabric piece, (8b) removing the first and second rows of fabric pieces from the product map;

(8c) positioning and pinning the bottom sides of two rows of fabric pieces together from left to right corners of each of the fabric pieces in the row of fabric pieces and sewing under the tactile border strip of the bottom sides of the first to the last fabric pieces in the row of fabric pieces;

(8d) unfolding the rows of fabric pieces so the right side of the fabric pieces are facing up, and the wrong sides with the hook and loop fastener are facing down and on the right side of fabric pieces, and (8e) attaching the hook and loop fastener from the right most piece of the first row of fabric pieces to the at least one hook and loop fastener strip of the product map from which it originated; and (9) sewing the remaining rows of fabric pieces together by following steps 8a-8e until all the rows of fabric pieces are sewn together to create the product pattern.

13. The tactile sewing system of claim 1 further comprising:

a first fastener coupling the first fabric piece and the second fabric piece at the at least one attachable edge of the first fabric piece and the at least one attachable edge of the second fabric piece;

the first fabric piece and the second fabric piece comprising a first row of fabric pieces; and a product book comprising a first book sleeve configured to removably retain the first row of fabric pieces.

14. The tactile sewing system of claim 13 further comprising:

a third fabric piece and a fourth fabric piece coupled at an attachable edge of the third fabric piece and an attachable edge of the fourth fabric piece by a second fastener;

the third fabric piece and the fourth fabric piece comprising a second row of fabric pieces; and a second book sleeve configured to removably retain the second row of fabric pieces.

15. The tactile sewing system of claim 14 further comprising:

a first tactile indicator coupled to one of the first fabric piece or the second fabric piece whereby a relative orientation of the first row of fabric pieces within the product pattern may be tactilely determined; and a second tactile indicator coupled to one of the third fabric piece or the fourth fabric piece whereby a relative orientation of the second row of fabric pieces within the product pattern may be tactilely determined.

16. The tactile sewing system of claim 15 further comprising:

an organizer configured to provide a specific placeholder for a thread whereby the thread can be located tactilely and a spool of the thread is kept from rolling away while unwinding the thread;

a set of sewing tools comprising:

one or more large eye needles,
one or more scissors,
one or more threader,
one or more threading assist tool,
one or more placeholder clip,
one or more seam ripper,
one or more pin,
one or more thimble,
one or more rubber needle puller,
one or more thread waxing container, and
one or more wrist pin cushion; and the organizer is further configured to hold the sewing tools in a memorable storage area.

17. A method of using the tactile sewing system of claim 15, the method comprising:

(1) removing the first row of fabric pieces from the first book sleeve in the product book;

(2) orienting the first row of fabric pieces within the product pattern using the first tactile indicator and placing the first row of fabric pieces whereby the wrong side of the first row of fabric pieces are facing downward toward a surface;

(3) folding over the right most fabric piece of the first row of fabric pieces onto the right side of an adjacent fabric piece whereby the wrong side of the right most fabric piece of the first row of fabric pieces is facing upward;

(4) reorienting the of the first row of fabric pieces in a top down columnar format whereby the fabric pieces that were on the right side are now be the top most fabric pieces in the top down columnar format;

(5) pinning the first and second fabric pieces together from a corner to another corner with a straight pin through the tactile border strips to secure the first and second fabric pieces in place before sewing;

(6) sewing the first and second fabric pieces together with a thread and stitches just inside a corner intersection of the tactile border strips and creating an appropriate seam allowance as guided by the tactile border strips;

(7) tying-off the stitches and cutting the thread;

(8) placing the sewn first row of fabric pieces back into the first book sleeve and moving on to the second book sleeve in the product book;

(9) follow steps 1-8 for the second row of fabric pieces;

(10) removing the sewn first row of fabric pieces from the product book first book sleeve and setting the first row of fabric pieces on the surface with the first tactile indicator aligned properly;

(11) removing the sewn second row of fabric pieces from the second book sleeve and setting the second row of fabric pieces on the surface adjacent to and underneath the fabric pieces from the first book sleeve with the second tactile indicator aligned properly;

(12) flipping the wrong side of the second row of fabric pieces up and over the first row of fabric pieces whereby the attachable edges of the fabric pieces in the second row of fabric pieces align with the attachable edges of the fabric pieces in the first row of fabric pieces whereby the wrong sides of the fabric pieces are facing outward with the tactile border strips facing outward;

(13) pinning a bottom side of both quilt rows together from left to right corners of each of the quilt pieces in the row;

(14) sewing just inside the tactile border strip of the bottom sides of the first to the last quilt pieces in the row;

(15) unfolding the rows so the right sides of the fabric pieces is facing up, and the wrong sides of the fabric pieces are facing down with the first and second tactile indicator still on a left most fabric piece of the rows.

18. A tactile sewing kit, the kit comprising:

a first fabric piece and a second fabric piece each having at least one attachable edge, a right side and a wrong side;

a first tactile border strip and a second tactile border strip;

the first tactile border strip coupled to the wrong side and proximal to the at least one attachable edge of the first fabric piece;

the first tactile border strip generally covering a portion of the first fabric piece and together defining a first piece trim section extending along the at least one attachable edge of the first fabric piece;

the second tactile border strip coupled to the wrong side and proximal to the at least one attachable edge of the second fabric piece;

the second tactile border strip generally covering a portion of the second fabric piece and together defining a second piece trim section extending along the at least one attachable edge of the second fabric piece; and the first piece trim section and the second piece trim section configured to provide a tactile means for a user to mate the first piece trim section and the second piece trim section to form a joint of a product pattern.

19. The tactile sewing kit of claim 18 further comprising:

a product book configured to organize a plurality of rows of fabric pieces whereby the rows are aligned according to the product pattern.

20. The tactile sewing kit of claim 19 further comprising:

an organizer configured to provide a specific placeholder for a thread and a thread spool whereby the thread can be located tactilely and the thread spool is kept from rolling away while unwinding the thread;

a set of sewing tools comprising:

one or more large eye needles, one or more scissors, one or more threader, one or more threading assist tools, one or more placeholder clips, one or more seam rippers, one or more pins, and one or more wrist pin cushion; and the organizer is further configured to hold the sewing tools.

* * * * *